US008100108B2

(12) United States Patent
Brewer et al.

(10) Patent No.: US 8,100,108 B2
(45) Date of Patent: Jan. 24, 2012

(54) HYDRAULICALLY OPERATED CHARGE AIR SYSTEM FOR INTERNAL COMBUSTION ENGINE

(75) Inventors: Todd Brewer, Dearborn, MI (US); Katherine Jane Randall, Dearborn Heights, MI (US)

(73) Assignee: Ford Global Technologies, Dearborn, MI (US)

( * ) Notice: Subject to any disclaimer, the term of this patent is extended or adjusted under 35 U.S.C. 154(b) by 407 days.

(21) Appl. No.: 12/470,542

(22) Filed: May 22, 2009

(65) Prior Publication Data

US 2010/0294238 A1 Nov. 25, 2010

(51) Int. Cl.
*F02B 31/00* (2006.01)

(52) U.S. Cl. ..... 123/306; 123/308; 123/184.21

(58) Field of Classification Search ..... 123/306, 123/308, 336, 184.21, 184.38, 184.53
See application file for complete search history.

(56) References Cited

U.S. PATENT DOCUMENTS

| | | | | |
|---|---|---|---|---|
| RE28,933 | E * | 8/1976 | Huber | 418/61.3 |
| 4,145,168 | A * | 3/1979 | Smith et al. | 418/150 |
| 4,180,041 | A | 12/1979 | Miyazaki et al. | |
| 4,679,488 | A * | 7/1987 | Krutz et al. | 91/1 |
| 4,819,953 | A | 4/1989 | Joh | |
| 5,107,804 | A | 4/1992 | Becker et al. | |
| 5,145,190 | A | 9/1992 | Boardman | |
| 5,267,543 | A | 12/1993 | Novak et al. | |
| 5,280,769 | A | 1/1994 | Yates | |
| 5,657,725 | A | 8/1997 | Butterfield et al. | |
| 5,704,333 | A | 1/1998 | Okumura et al. | |
| 5,957,464 | A | 9/1999 | Elliott | |
| 6,055,806 | A | 5/2000 | Dalton | |
| 6,311,986 | B1 | 11/2001 | Richardson et al. | |
| 6,662,772 | B1 | 12/2003 | Murphy | |
| 6,763,802 | B1 | 7/2004 | Brassell | |
| 7,096,849 | B1 | 8/2006 | Mathis et al. | |
| 7,337,758 | B2 | 3/2008 | Sturdy et al. | |
| 2004/0134192 | A1 | 7/2004 | Umehara et al. | |
| 2005/0179215 | A1 | 8/2005 | Kono | |
| 2007/0017468 | A1 | 1/2007 | Letourneau et al. | |
| 2008/0271697 | A1 | 11/2008 | Vichinsky | |

FOREIGN PATENT DOCUMENTS

JP 2002106428 A 4/2002

* cited by examiner

*Primary Examiner* — John Kwon
(74) *Attorney, Agent, or Firm* — Jerome R. Drouillard; Julia Voutyras

(57) ABSTRACT

A hydraulically operated charge air system for an internal combustion engine includes an intake manifold having a number of intake runners, and a number of rotatable airflow control devices mounted within at least a portion of the intake runners. A hydraulic motor rotatably positions the airflow control devices.

13 Claims, 3 Drawing Sheets

HYDRAULICALLY OPERATED CHARGE AIR SYSTEM FOR INTERNAL COMBUSTION ENGINE

CROSS REFERENCE TO RELATED APPLICATIONS

None.

BACKGROUND OF THE DISCLOSURE

1. Field of the Disclosure

The present disclosure relates to a charge air system for an internal combustion engine having a hydraulically operated airflow control capability associated with the engine's intake manifold.

2. Related Art

Devices for controlling the flow of charge air within an intake manifold have typically used either vacuum or electrical power. Each of these types of power source is characterized by certain shortcomings. In the case of vacuum devices, vacuum availability under some operating conditions, such as operation at high altitude, may be a problem. In the case of electrical devices, package space and reliability present issues. Moreover, with both types of systems, failure mode management may be an issue. Excessive noise, and, in the case of electrical devices, electromagnetic compatibility, may also be issues, as is high cost, it being understood that cost reduction is a never ending goal in the automotive design field.

It would be desirable to provide an internal combustion engine charge air system having airflow control devices which overcome the difficulties associated with electrical and vacuum powered devices, while avoiding excessive cost.

SUMMARY

According to an aspect of the present disclosure, a hydraulically operated charge air system for an internal combustion engine includes an intake manifold having a number of intake runners and a number of rotatable airflow control devices mounted within at least a portion of the intake runners. A hydraulic motor rotatably positions the airflow control devices according to instructions from either a controller which contains a predetermined control strategy, or as a function of engine oil pressure, independently of a controller. For example, a hydraulic motor positioning airflow control devices used with long/short runner control may be operated according to an engine's speed and load.

According to another aspect of the present disclosure, an intake manifold may have a number of short intake runners and a number of long intake runners, with rotatable airflow control devices being configured as intake runner control valves mounted within the short intake runners.

According to another aspect of the present disclosure, rotatable airflow control devices may include charge motion control valves, particularly valves having a control area which is less than the flow area of the intake runner within which the valve plate is mounted. In either case, rotatable airflow control devices will be mounted upon a rotatable shaft which is coupled to the hydraulic motor.

According to another aspect of the present disclosure, the hydraulic motor may be powered by an engine lubrication pump, with the motor including a housing and a multi-lobed rotor rotatably positioned within the housing so that engine oil passing through appropriate control ports will cause the rotor to position the airflow control devices in a desired rotational location.

It is an advantage of the present system that the package volume required for the system will be less than that required for known pneumatic or electrodrive systems.

It is a further advantage of the present system that problems with electromagnetic compatibility and audible noise are eliminated.

It is yet another advantage of the present system that the response speed is very high due to the operating principles of the hydraulic motor which positions the flow control devices.

It is yet another advantage of the present system that the cost for a charge air system is low compared to known vacuum and electrically driven devices.

Other advantages, as well as features of the present system, will become apparent to the reader of this specification.

DETAILED DESCRIPTION OF THE PREFERRED EMBODIMENTS

Figure 1:
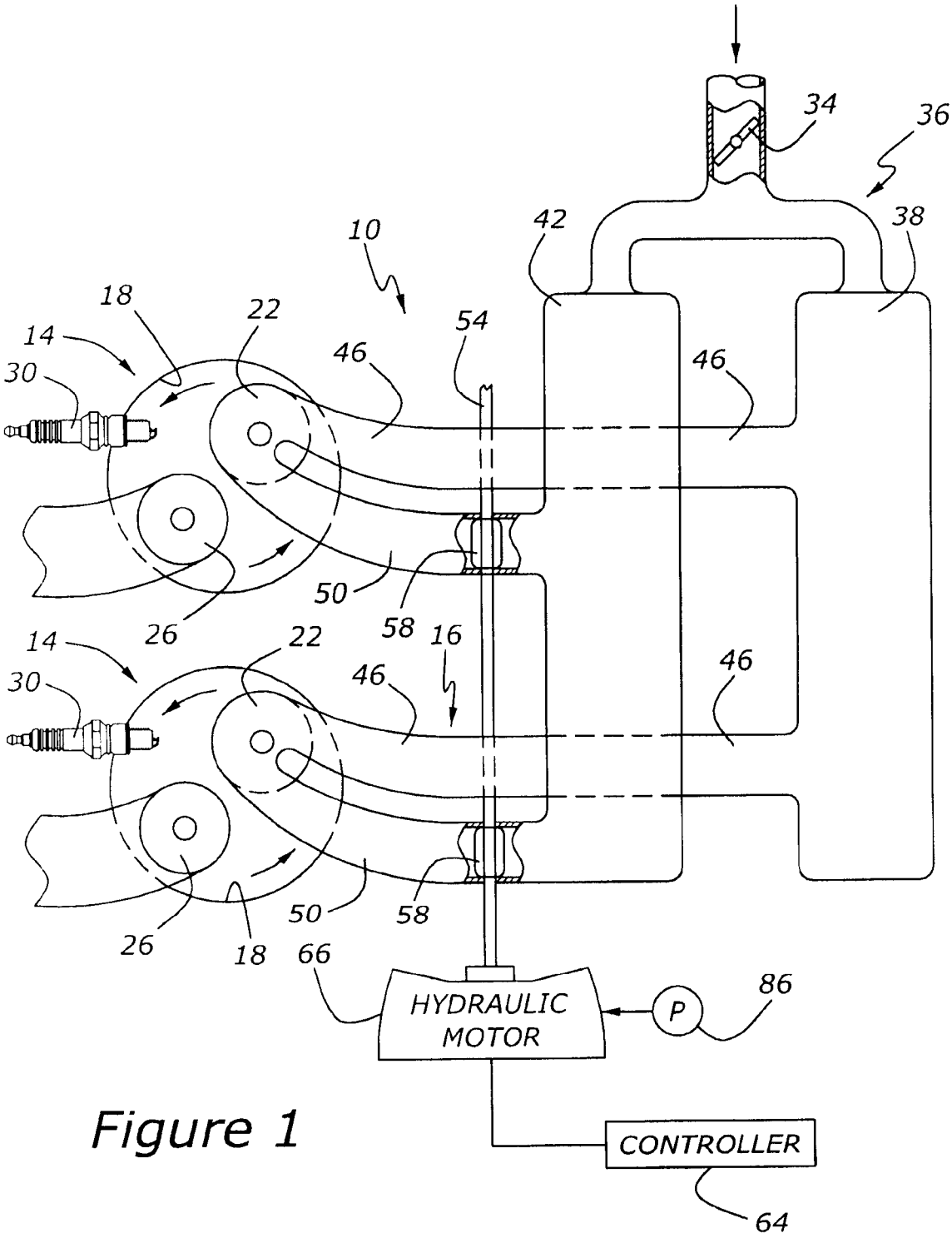
FIG. 1 is a schematic representation of an internal combustion engine having a hydraulically operated charge air system according to the present disclosure.

As shown in FIG. 1, a hydraulically operated charge air system, 10, is mounted to an engine, 14, having cylinder head 16, cylinders, 18, equipped with intake valves, 22, and exhaust valves, 26, as well as spark plugs, 30. A throttle plate, 34, which is mounted to intake manifold 36, governs the amount of air entering engine 14. Air flowing past throttle plate 34 enters a first plenum, 38 and a second plenum, 42. Long intake runners, 46, extend from first plenum 38 to cylinders 18, and short intake runners, 50, extend from plenum 42 to cylinders 18. An airflow control device, shown as a runner control valve, 58, in FIG. 1, is mounted in each of short intake runners 50. The position of runner control valves 58 is controlled by hydraulic motor 66, which is operated by controller 64, and provided with pressurized lubricating oil through cylinder head 16 by engine oil pump 86.

Figure 2:
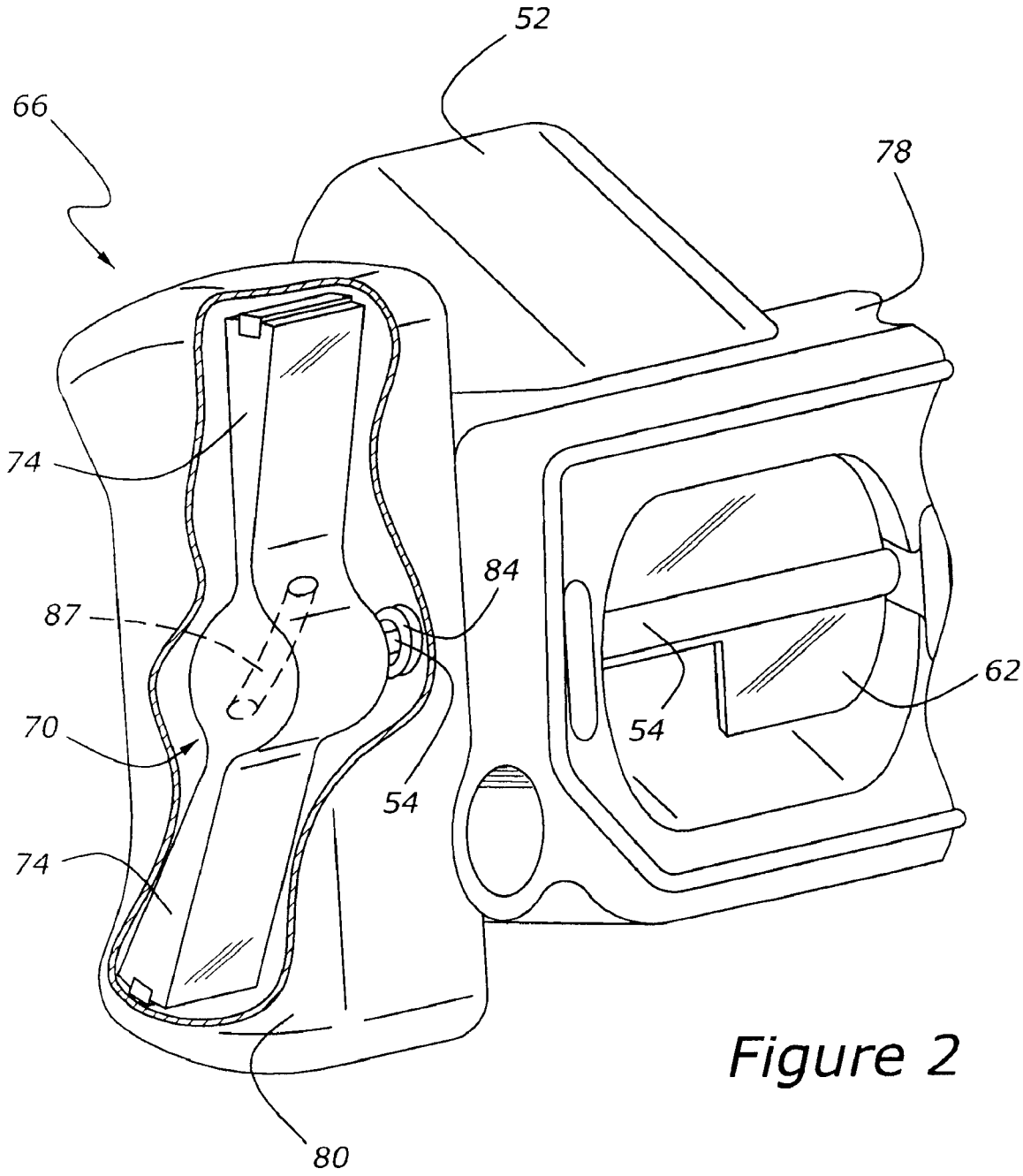
FIG. 2 is a perspective view of a portion of an intake manifold according to the present disclosure, showing the inventive hydraulically operated charge air system.

FIG. 2 shows a rotatable control shaft, 54, as being mounted in close proximity to intake manifold mounting flange 78. In the embodiment of FIG. 2, a charge motion control valve (CMCV) plate, 62, is mounted within each of the runners 52. FIG. 2 also shows hydraulic motor 66, including housing 80 and rotor 70 having two vanes, 74, mounted thereupon. A torsion spring, 84, is used to drive rotatable control shaft 54, including CMCV plate, 62, to its closed position when oil pressure is not supplied, as well as in the event of a loss of control strategy. Those skilled in the art will appreciate in view of this disclosure that a single engine could be equipped with not only runner control valves, but also charge motion control valves, with both types of valves operated according to the present disclosure.

Figure 3:
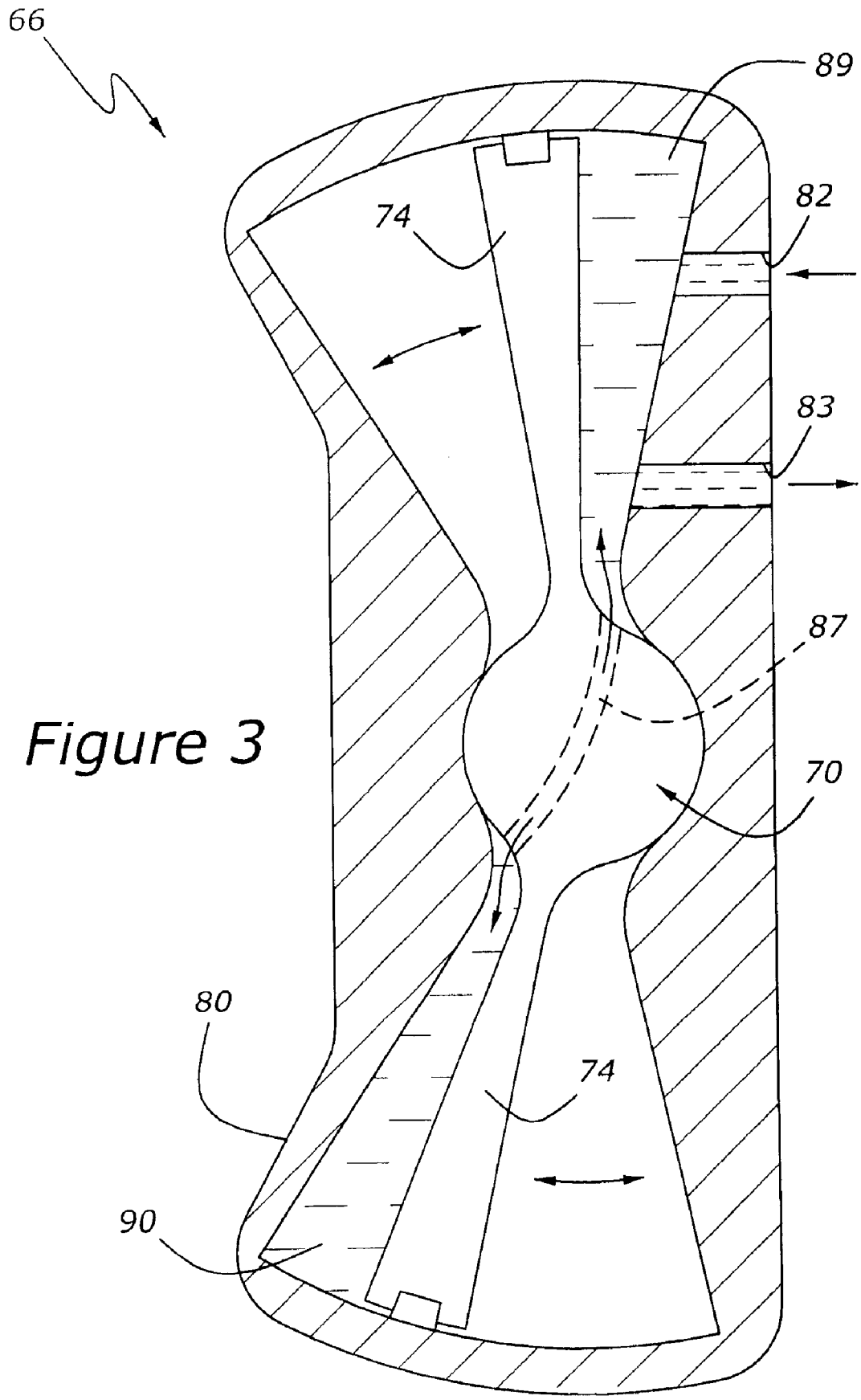
FIG. 3 is a partially schematic view of a hydraulic motor used with the present charge air system.

FIG. 3 shows additional details of hydraulic motor 66, including an oil feed passage, 82, and a return passage, 83, which communicate with oil passages (not shown) provided within cylinder head 16. Oil feed passage 82 is selectively provided with pressurized engine oil which flows into upper chamber 89, so as to cause rotor 70 to rotate counterclockwise to a desired location for a CMCV or runner control valve, as the case may be. Passage 87 allows oil to flow through rotor 74 to lower chamber 90. When passage 83 is opened, oil is allowed to leave chambers 89 and 90, and torsion spring 84 drives vane 74 and control shaft 54 to the closed position.

Those skilled in the art will appreciate in view of this disclosure that rotor 70 could be configured with more than two lobes, alternatively, rotor 70 could be equipped with a single lobe; such details are committed to the discretion of those seeking to employ the present system. Moreover, the present system may be employed with engines having configurations which are different from that shown in FIG. 1.

Vanes 74 of rotor 70 have an included angle of about 140°, which is configured in order to match the maximum rotation of rotor 70 to the valve plate opening angle. Vanes 74 could have a range of included angles therebetween. Advantageously, hydraulic motor 66 does not extend past the parting line between cylinder head 16 and intake manifold 36.

Airflow control device 62 is illustrated in FIG. 2 as having a control area which approximates about seventy-five percent of the flow area of intake runner 52 at the location in which device 62 is mounted. Those skilled in the art will appreciate in view of this disclosure, however, that other types of CMCV devices may be suitable for use with the present system, it being clear that the illustrated device is merely an example of a whole range of such devices.

The foregoing system has been described in accordance with the relevant legal standards, thus the description is exemplary rather than limiting in nature. Variations and modifications to the disclosed embodiments may become apparent to those skilled in the art and fall within the scope of the disclosure. Accordingly the scope of legal protection can only be determined by studying the following claims.

What is claimed is:

1. A hydraulically operated charge air system for an internal combustion engine, comprising:

an intake manifold having a plurality of intake runners;

a plurality of rotatable airflow control devices mounted within at least a portion of said intake runners; and a hydraulic motor for rotatably positioning said airflow control devices, wherein said hydraulic motor comprises a vane motor having a multi-lobed rotor container within a housing mounted to said intake manifold, with said rotor being coupled to a rotatable shaft carrying said rotatable airflow control devices.

2. A charge air system according to claim 1, wherein said intake manifold has a plurality of short intake runners and a plurality of long intake runners.

3. A charge air system according to claim 2, wherein said rotatable airflow control devices are mounted within said short intake runners.

4. A charge air system according to claim 1, wherein said rotatable airflow control devices comprise both charge motion control valves and runner control valves.

5. A charge air system according to claim 1, wherein said rotatable airflow control devices comprise charge motion control valves configured as plate valves, with each plate valve having a control area which is less than the flow area of the intake runner into which the plate valve is mounted.

6. A charge air system according to claim 1, wherein said rotatable airflow control devices comprise runner control valves.

7. A charge air system according to claim 1, wherein said multi-lobed rotor has two lobes with an included angle of about 140°.

8. A hydraulically operated charge air system for an internal combustion engine, comprising:

an intake manifold having a plurality of intake runners;

a plurality of airflow control devices carried upon a rotatable shaft, comprising charge motion control valves mounted within said intake runners adjacent an intake manifold mounting flange; and a hydraulic motor for rotatably positioning said rotatable shaft, wherein said hydraulic motor comprises a vane motor having a multi-lobed rotor contained within a housing mounted to said intake manifold and powered by an engine lubrication pump.

9. A hydraulically operated charge air system according to claim 8, wherein each of said charge motion control valves is configured as a plate valve with a control area which is less than the flow area of the intake runner within which the plate valve is mounted.

10. A hydraulically operated charge air system according to claim 9, wherein each of said plate valves is configured with a control area approximating 75 percent of the flow area of the intake runner within which the plate valve is mounted.

11. A hydraulically operated charge air system for an internal combustion engine, comprising:

an intake manifold having a plurality of shorter intake runners and a plurality of longer intake runners;

a plurality of rotatable airflow control devices, comprising runner control plate valves mounted upon a rotatable shaft within at least a portion of said intake runners; and a hydraulic vane motor comprising a multi-lobed rotor contained within a housing mounted to said intake manifold for rotatably positioning said rotatable shaft, wherein said hydraulic motor is powered by an engine lubrication pump.

12. A hydraulically operated charge air system according to claim 11, wherein each of said runner control valves is mounted within one of said shorter intake runners.

13. A hydraulically operated charge air system according to claim 11, wherein said runner control valves are mounted adjacent an intake manifold mounting flange.

* * * * *